United States Patent [19]

Rowe et al.

[11] Patent Number: 4,987,632

[45] Date of Patent: Jan. 29, 1991

[54] WIPING ARTICLE

[75] Inventors: Gavin B. Rowe; Andrew N. Smith; Alan Wooten, all of Northants, England

[73] Assignee: Lever Brothers Company, New York, N.Y.

[21] Appl. No.: 731,203

[22] Filed: May 6, 1985

[30] Foreign Application Priority Data

May 11, 1984 [GB] United Kingdom ..... 8412047
May 11, 1984 [GB] United Kingdom ..... 8412044

[51] Int. Cl.[5] ..... A47L 13/17; A47K 7/03; C11D 17/04

[52] U.S. Cl. ..... 15/104.93; 15/209 R

[58] Field of Search ..... 15/104.93, 104.94, 209 R; 252/90, 91, 92, 93; 424/19, 21, 27, 28; 428/264, 265

[56] References Cited

U.S. PATENT DOCUMENTS

| | | | |
|---|---|---|---|
| 3,121,249 | 2/1964 | Affleck et al. | 15/104.93 |
| 3,284,963 | 11/1966 | Lanham et al. | 15/104.93 X |
| 3,324,500 | 6/1967 | Fuller et al. | 15/104.93 |
| 3,788,999 | 1/1974 | Abler | 252/91 |
| 4,145,302 | 3/1979 | Doan | 15/104.93 X |
| 4,188,447 | 2/1980 | Ehlenz | 15/104.93 X |
| 4,189,395 | 2/1980 | Bland | 15/104.93 X |
| 4,193,887 | 3/1980 | Stone et al. | 15/104.93 X |
| 4,303,543 | 12/1981 | Mansy | 252/117 |
| 4,517,006 | 5/1985 | Drake et al. | 424/28 X |

FOREIGN PATENT DOCUMENTS

| | | |
|---|---|---|
| 68516 | 1/1983 | European Pat. Off. . |
| 68722 | 1/1983 | European Pat. Off. . |
| 1519418 | 7/1969 | Fed. Rep. of Germany . |
| 2460239 | 7/1975 | Fed. Rep. of Germany . |
| 2625176 | 12/1977 | Fed. Rep. of Germany . |

*Primary Examiner*—Harvey C. Hornsby
*Assistant Examiner*—Scott J. Haudand
*Attorney, Agent, or Firm*—Milton L. Honig

[57] ABSTRACT

A substantially dry-to-the-touch wiping article which is suitable for use in cleaning soiled surfaces in the presence of water, comprises an absorbent substrate, having a water-absorption capacity of at least 1g/g, in compound, the surface of the absorbent substrate having applied thereon a moisture barrier to cover at least 10% of the total area of each side of the sheet in such a manner that the moisture barrier on one side coincides with the moisture barrier on the opposite side, so as to form a sandwich enclosing at least 10% of the area of the absorbent substrate impregnated with detergent active compound.

14 Claims, 1 Drawing Sheet

WIPING ARTICLE

TECHNICAL FIELD

The invention relates to a wiping article suitable for use in cleaning soiled surfaces in the presence of water. The wiping article can be adapted for cleaning hard surfaces, particularly those to be found in the domestic kitchen and bathroom, or for cleaning the surface of the human body, particularly when taking a shower.

BACKGROUND AND PRIOR ART

When cleaning a hard surface in the kitchen or bathroom, for example the floor, sink, bath or working surface used for food preparation, it is convenient for reasons of hygiene to employ a wiping article such as a nonwoven cloth, or a paper kitchen roll, for mopping up spills or for cleaning soil from the surface. Such wiping articles can be used in the dry state if employed for removal of aqueous or fatty liquid spills, or in a wet or damp state if the surface to be cleaned is relatively dry.

Whether used wet or dry, such wiping articles perform more effectively in the presence of a detergent active compound which will generally be applied separately to the wiping article or to the surface at the time of use.

It has been proposed in German No. OLS 2 625 176 (Schickedanz) to provide a cleaning cloth for hard surfaces manufactured from nonwoven fabric containing a supply of meltable active detergent in the form of stripes applied superficially to the fabric from the molten state. A water insoluble hydrophobic plastic can be applied to the fabric to divide it into a portion having the detergent coating and an untreated portion having no detergent.

Such cleaning cloths do, however, suffer from the disadvantage that when used in the presence of water to clean a hard surface, the detergent active with which they are impregnated tends to be leached out and washed away leaving the article exhausted of soap or detergent after only a single use. Such cleaning cloths also can disintegrate, particularly when paper of low wet strength is employed in their manufacture.

Alternatively, when taking a shower, it is usual for the whole of the body surface, including the hair, to be sprayed with water. Conventionally, a soap bar or a semi-liquid shower gel preparation containing liquid detergent is used to form a lather on the skin surface to promote cleaning. It is also usual to employ a liquid or semi-liquid shampoo for cleaning the hair during the showering routine. It is accordingly traditional to employ at least one and frequently two products for cleaning the body surface when showering, and neither of these is particularly convenient to use, for the soap bar can easily slip from the fingers and the bottle or other container of shower gel or shampoo can be knocked over or dropped, with obvious inconvenience and wastage of product.

It would accordingly be advantageous to provide a means whereby these disadvantages could be avoided and showering made more convenient.

It has been proposed to impregnate a fibrous paper tissue or cloth with a detergent formulation for use in hand dishwashing or for bathing the baby. In both cases, however, a relatively small amount of water is involved, and therefore the quantity of detergent held by the paper tissue or cloth is inadequate for use where a larger volume of running water is involved, such as when showering.

It has also been proposed in European Patent Application No. 0 068 516 (Barbey & Hecken) to provide a disposable wash cloth made from cellulose plastics, fabric or paper in the form of a pouch to fit over the hand for use when bathing, the wash cloth containing a cleaning composition based on sodium lauryl ether sulphate (10%), N-$\beta$-hydroxyethyl-N-$\beta$-carboxyethyl fatty acid amidoethylamine sodium salt (5%), and coconut fatty acid diethanolamide (2%).

It has also been proposed in U.S. Pat. No. 4 303 543 (Procter & Gamble) to provide a dry article for cleaning the skin, the article comprising an absorbent paper or woven or nonwoven cloth impregnated with a composition comprising a soap and a stearyl ammonium laurate or stearate skin conditioning agent.

Such prior art articles do, however suffer from the disadvantage that if used to clean the body surface when showering, the soap or detergent active with which they are impregnated tends to be leached out and washed away prematurely leaving the article exhausted of soap or detergent before cleaning is complete. Such articles also tend to disintegrate in use, particularly when paper of low wet strength is employed in their manufacture.

It is accordingly apparent from the foregoing that prior proposals describing detergent-impregnated wiping cloths for use in cleaning either hard surfaces of the type found in the kitchen or bathroom, or the body surface, for example when taking a shower, suffer from a common problem in that the detergent tends to be leached out rapidly in use with the result that such wiping cloths have a relatively short life and are in any case not reusable.

In order to overcome problems such as those outlined above, we have now developed an improved detergent-impregnated wiping article for use particularly in the presence of water when cleaning soiled surfaces, which article is capable of releasing detergent active in a controlled manner, such that the article can be used over an extended period of time or on several separate occasions before the detergent active is exhausted and the article disposed of. During use, release of the detergent active is controlled by a moisture barrier applied to at least part of the surface of the article. The article also has a wet strength such that it is resistant to disintegration when employed under normal conditions of use when cleaning a soiled surface. After use, the article can if appropriate be rinsed briefly with water to remove soil before being used again.

DEFINITION OF THE INVENTION

Accordingly, the invention provides a substantially dry-to-the-touch wiping article which is suitable for use in cleaning soiled surfaces in the presence of water, the article comprising an absorbent substrate, having a water-absorption capacity of at least 1 g/g, in the form of a sheet impregnated with detergent active compound, the surface of the absorbent substrate having applied thereon a moisture barrier to cover at least 10% of the total area of each side of the sheet in such a manner that the moisture barrier on one side coincides with the moisture barrier on the opposite side, so as to form a sandwich enclosing at least 10% of the area of the absorbent substrate impregnated with detergent active compound.

DISCLOSURE OF THE INVENTION

Absorbent Substrate

The absorbent substrate which acts as a carrier for the detergent active compound with which it is impregnated is preferably a nonwoven fabric sheet having a thickness of from 100 to 1000 μm comprising cellulose fibres which are particularly suitable in view of their ability rapidly to absorb water when employed to clean a soiled surface.

The absorbent substrate of the article can also comprise other fibrous materials such as polyamide, polyester and polypropylene, or mixtures of such fibres, which are particularly useful in providing the article with extra wet strength.

The wet strength of the absorbent substrate can also be increased by incorporation of suitable binders such as styrene butadiene lattices, or an acrylic binder, for example PRIMAL HA8, or polyvinyl acetate, or polymer emulsions, such as self cross-linking vinyl acetate/ethylene copolymer emulsions, for example VINAMUL R32300 and R32337, self cross-linking vinyl acetate/acrylic copolymer emulsions, such as VINACRYL 4315.

PRIMAL polymer emulsions are manufactured by Rohm and Haas, and VINAMUL and VINACRYL polymer emulsions are manufactured by Vinyl Products Limited. PRIMAL, VINAMUL and VINACRYL are trade marks.

The absorbent substrate can be made from paper, in which case it will generally comprise cellulose fibres which are relatively short in length, additives, such as hydroxyethyl cellulose, being employed to provide added wet strength.

The absorbent substrate should have a water absorption capacity of at least 1 g/g, preferably at least 3 g/g; i.e. it should be capable of absorbing an amount of water which is at least equal to its own weight, preferably at least equal to three times its own weight.

When the substrate comprises a binder or additional fibrous material for increasing its intrinsic wet strength, it is possible that the water absorption capacity of the substrate will thereby be reduced compared with that of the substrate without binder. It is accordingly important to ensure that the choice of a binder or additional fibre and the amount of binder or fibre present in the substrate for the purpose of increasing its wet strength is insufficient to reduce its water absorption capacity below this minimum value of 1 g/g.

The water absorption capacity of a substrate can be measured gravimetrically, simply by weighing a piece of the substrate in the dry state and again following immersion in water after surplus water has drained away. The difference between these two weighings divided by the dry weight is the water absorption capacity expressed in g/g.

The absorbent substrate should preferably have a minimum wet tensile strength of at least 50 Newtons per metre (N/m). The minimum wet tensile strength of the matrix can exceed 50 N/m and is preferably at least 80 N/m, most preferably at least 95 N/m. Although there is no definitive upper limit to the wet tensile strength of the matrix, it is unlikely to exceed 1000 N/m, and will normally not exceed 500 N/m.

The wet tensile strength can be measured by the method recommended by European Disposables and Nonwoven Association (EDANA) as DIN 53857.

In this method, a substrate width of 50mm and a substrate length of 150 mm is employed as the standard. A jaw separation rate of 150 mm per minute is employed in the test and the wet tensile strength of a given test substrate is expressed in newtopns per metre (N/m).

It should be explained that the wet tensile strength of a machine laid absorbent substrate that is constructed in the form of a continuous web and is conveniently stored as a roll, will generally be greater in the direction of the web, i.e. "machine direction", than at right angles to the web, i.e. "cross direction". The minimum wet tensile strength referred to above will accordingly apply to the direction which exhibits the lower or lowest wet tensile strength, i.e. generally in the "cross direction".

A preferred absorbent substrate is a nonwoven comprising cellulose fibres an example of which is MITSUBISHI TCF 408, a 100% cuprammonium rayon spun bonded nonwoven having the following technical specification:

| | |
|---|---|
| Nominal basis weight (g/m$^2$) | 82.5 |
| Thickness (μm) | 500 |
| Dry tensile strength : machine direction (N/m) | 635 |
| Dry tensile strength : cross direction (N/m) | 565 |
| Wet tensile strength : machine direction | 498 |
| Wet tensile strength : cross direction (N/m) | 447 |
| Absorption capacity (g/g) | 5 |

A further preferred absorbent nonwoven substrate comprising cellulose fibres is AIRTEX SC 150, a resin bonded cellulose pulp available from the James River Corporation and having the following technical specification:

| | |
|---|---|
| Nominal basis weight (g/m$^2$) | 86 |
| Thickness (μm) | 850 |
| Dry tensile strength : machine direction (N/m) | 450 |
| Dry tensile strength : cross direction (N/m) | 347 |
| Wet tensile strength : machine direction (N/m) | 323 |
| Dry tensile strength : cross direction (N/m) | 297 |
| Absorption capacity (g/g) | 11 |
| Resin binder (%) | 25 |

The resin with which AIRTEX SC 150 is bonded is a self crosslinking ethylene/vinyl acetate copolymer emulsion.

A further example of an absorbent substrate is a nonwoven comprising cellulose fibres such as STORALENE 715:50 or STORALENE 717:50 available from Stora-Kopparberg, Sweden, which contains the following ingredients:

| | % per w/w |
|---|---|
| Cellulose fibres (wood pulp) | 33 |
| Cotton linters | 29 |
| Rayon | 17 |
| Polyamide | 4 |
| Binder* | 17 |

*STORALENE 715:50 contains an acrylic binder and STORALENE 717:50 contains a polyvinyl acetate binder.

The relevant technical specification of STORALENE 715:50 and STORALENE 717:50 are set out below:

| | STORALENE | |
|---|---|---|
| | 715:50 | 717:50 |
| Nominal basis weight (g/m$^2$) | 50 | 50 |
| Thickness (μm) | 400 | 365 |
| Dry tensile strength-machine direction (N/m) | 600 | 625 |
| Dry tensile strength-cross direction (N/m) | 450 | 330 |
| Wet tensile strength-machine direction (N/m) | 300 | 205 |
| Wet tensile strength-cross direction (N/m) | 250 | 95 |
| Absorption capacity (g/g) | 4 | 4 |

Other suitable STORALENE wet laid nonwovens include 715-80, 741-50 and HMS 04-75.

A further example of an absorbent substrate that can be employed in the manufacture of the articles of the invention is DEXTER 5343, which is a wet laid nonwoven comprising short cellulose fibres.

The relevant technical specification of DEXTER Grade 5343 is set out below:

| | DEXTER Grade 5343 |
|---|---|
| Nominal basis weight (g/m$^2$) | 50 |
| Thickness (μm) | 190 |
| Dry tensile strength : machine direction (N/m) | 2,500 |
| Dry tensile strength : cross direction (N/m) | 1,000 |
| Wet tensile strength : machine direction (N/m) | 375 |
| Wet tensile strength : cross direction (N/m) | 150 |
| Absorption capacity (g/g) | 4 |

A further example of an absorbant substrate that can be employed in the manufacture of articles of the invention is TAMPELLA K286/50, which is a wet laid nonwoven comprising short cellulose fibres, available from Tampella Oy, Finland.

The relevant technical specification of TAMPELLA K286/50 is set out below:

| | TAMPELLA K286/50 |
|---|---|
| Normal basis weight (g/m$^2$) | 50 |
| Dry tensile strength: machine direction (N/m) | 913 |
| Dry tensile strength: cross direction (N/m) | 680 |
| Wet tensile strength: machine direction (N/m) | 413 |
| Wet tensile strength: cross direction (N/m) | 320 |
| Elongation: machine direction (%) | 11.2 |
| Elongation: cross direction (%) | 11.5 |
| Dry tear strength: machine direction (N) | 4.4 |
| Dry tear strength: cross direction (N) | 4.4 |
| Wet tear strength: machine direction (N) | 2.7 |
| Wet tear strength: cross direction (N) | 3.0 |
| Dry burst strength (kPA) | 157 |
| Wet burst strength (kPA) | 93 |

Other suitable TAMPELLA wet laid nonwovens include K353-50 and K353-75.

It is to be understood that whereas the MITSUBISHI, AIRTEX, STORALENE, DEXTER and TAMPELLA nonwovens are the preferred absorbent substrates, there are many other similar fabrics, especially KIMTEX from Kimberley Clark and CHICOPEE 9302, which can be used as the absorbent substrate of the invention.

Detergent Active Compound

The absorbent substrate is impregnated with detergent active compound in a manner such that release of the detergent active compound in the presence of water, when the wiping article is required for cleaning a soiled surface, is achieved in a controlled manner, as will be made clear later in this specification.

Suitable detergent actives can be chosen from anionic, nonionic, amphoteric, zwitterionic and cationic detergents or compatible mixtures of detergents from two or more of these classes of detergents.

Examples of anionic detergents include alkyl benzene sulphonates, such as sodium alkyl benzene sulphonates and sodium alkyl naphthalene sulphonates; alkyl sulphates, particularly those having from 12 to 18 carbon atoms in the molecule, such as sodium lauryl sulphate and triethanolamine sulphate; alkyl benzene polyoxyethylene sulphonates, particularly those wherein the alkyl radical has from 8 to 12 carbon atoms; sulphated monoglycerides, such as lauric monoglyceride sodium sulphate, lauric monoglyceride ammonium sulphate and sulphated cocomonoglyceride ammonium salt; alcohol ether sulphates; sarcosines, such as lauroyl sarcosine and cocoyl sarcosine; and sulphosuccinates, such as the dioctyl esters of the salts of sulphosuccinic acid.

Examples of cationic detergents include distearyl dimethyl ammonium chloride, dilauryl dimethyl ammonium chloride diisobutylphenoxyethoxyethyl dimethyl benzyl ammonium chloride, cetyl trimethyl ammonium bromide, N-cetyl pyridinium bromide and benzethonium chloride.

Examples of amphoteric detergents include N-alkyl-β-imino dipropionates, N-alkyl-β-amino propionates and the basic quaternary ammonium compounds derived from 2-alkyl-substituted imidazoline such as hydroxyethyl carboxymethyl alkyl imidazolinium hydroxide (MIRANOL), especially the lauric, myristic or stearic derivatives.

Examples of nonionic detergents include condensates of ethylene oxide with hydrophobic bases formed by condensing propylene oxide with propylene glycol (PLURONICS), nonyl-phenoxypoly(ethylenoxy) ethanol (IGEPAL), and . polyoxyethylene(20)sorbitan monooleate (TWEEN 80).

Suitable detergents can also comprise soaps which are water soluble salts of higher fatty acids and include alkali metal soaps such as sodium, potassium, ammonium and alkanol ammonium salts of straight chain saturated or unsaturated fatty acids containing from 8 to 24 carbon atoms, preferably from 10 to 20 carbon atoms. Preferred soaps include potassium, monoethanolamine, diethanolamine and triethanolamine soaps of $C_{12}$ to $C_{14}$ fatty acids, particularly of coconut fatty acids.

At least part of the absorbent substrate is impregnated with detergent active compound at a concentration of not less than 0.2 g/g. The preferred amount and its distribution throughout the article will depend upon its intended end use.

Preferably, the impregnated absorbant substrate comprises a total of at least 0.4 g, most preferably at least 0.5 g and ideally at least 1 g of detergent active compound per g. Usually, the impregnated absorbent substrate will not comprise more than 2 g of detergent active compound per g.

The dry article can also optionally comprise detergent adjuncts including abrasives, foam stabilisers, germicides, perfumes, colourants, preservatives and inorganic salts.

When the dry article according to the invention includes an abrasive, preferred abrasive materials comprise mineral particles such as calcite beads such as polyvinyl chloride beads and polyalkylene beads. Preferably, such abrasive materials are securely bound to at least part of the absorbent substrate.

The Moisture Barrier

In order effectively to reduce the rate at which detergent active compound, with which the dry article is impregnated, is leached from the article when used for cleaning a soiled surface in the presence of water, the surface of the absorbent substrate has applied thereto a moisture barrier which covers at least part of the total surface area of the sheet.

The moisture barrier should be applied to corresponding areas on both sides of the sheet so as to provide a sandwich which will resist or restrict access of moisture to that portion of the sheet so protected. The presence of this barrier accordingly reduces the rate at which water can penetrate into the article and hence leach out detergent active compound and other water-soluble or water-dispersible substances during use, thereby enabling the article to be used for a longer than usual period of time or to be reused several times before it is exhausted of detergent active compound.

Examples of materials which can be employed to form the moisture barrier include hydrophobic materials such as wax emulsions, for example MESOWAX and GAMP.

MESOWAX and GAMP wax emulsions are manufactured by Grangersol Ltd; "MESOWAX" and "GAMP" are trade marks.

Other suitable hydrophobic materials include aqueous polymer emulsions (known as "binder resins"), silicones or mixtures of silicone oils and silicone waxes, certain grades of natural and synthetic rubbers, and resins such as Shellac, hot melts and waxes such as paraffin wax.

Examples of aqueous polymer emulsions include:

self cross-linking vinyl acetate ethylene copolymer emulsions such as VINAMUL R32337, VINAMUL R32300 and VINAMUL 3231;

vinyl acetate ethylene copolymer emulsion such as VINAMUL 3240 and VINAMUL 3252;

vinyl acetate acrylic copolymer emulsion such as VINAMUL 6815;

aqueous dispersion of self-reactive vinyl acetate/acrylic copolymer, such as NATIONAL 125 - 2833.

NATIONAL polymer emulsions are manufactured by National Starch & Chemicals Corporation.

Such hydrophobic materials can be applied to the surface of the substrate as a decorative feature.

It will be appreciated that certain polymer emulsions, such as VINAMUL R32337 can be employed both to increase the wet strength of the substrate and to form a moisture barrier.

Examples of hot melts include NATIONAL INSTANT-LOK 73, NATIONAL DISPOMELT 270 and NATIONAL DISPOMELT 350, which are available from National Adhesives.

INSTANT-LOK and DISPOMELT are trade marks.

It is also possible to employ hydrophilic materials such as polyvinyl alcohol, gelatin and certain starches to form the moisture barrier. Such materials initially reduce the rate at which water can penetrate the dry article but ultimately they dissolve or separate from the article, and hence can signal that leaching of detergent active compound from the article is complete. Such hydrophilic materials can, for example be applied to the surface of the article as a recognisable design pattern, motif or picture which will gradually disappear as washing proceeds.

Mixtures of hydrophobic and hydrophilic materials such as those exemplified herein can be employed.

As well as functioning as a moisture barrier, these materials can desirably increase the perceived bulk of the wiping article and improve its cleaning ability.

The dry article can also optionally comprise moisture barrier adjuncts, for example antiblocking agents, such as POLYMUL MS40 and NOPCO 1097A, to reduce any tendency for the dry articles to stick together.

POLYMUL MS40, a polyethylene emulsion, and NOPCO 1097A, a calcium stearate dispersion are available from Diamond Shamrock.

"POLYMUL" and "NOPCO" are trade marks.

The proportion of the total surface area of the absorbent substrate to which a moisture barrier is applied will depend on whether the barrier material is hydrophobic or hydrophilic in nature, and on the desired release time of the detergent active compound and other water-soluble or dispersible materials with which the article is impregnated.

The moisture barrier can accordingly cover the entire surface of the absorbent substrate when the barrier material is hydrophilic, whereas when a hydrophobic barrier material is employed, the area covered should not exceed 95% of the total surface area.

The moisture barrier should in general, therefore, cover from 10 to 95% of the total surface area of the absorbent substrate. If less than 10% of the total surface area is covered in this way, then it is likely that the rate at which detergent active compound is leached from the article is insignificantly less than that when no moisture barrier is provided. Conversely, if more than 95% of the total surface area is covered by the moisture impermeable film, then the rate at which detergent active compound can be leached from the article on contact with water can be inadequate for cleaning a soiled surface.

The material which is employed to form the moisture barrier can be a normally solid material, or a gel, or a highly viscous liquid, so long as after application, it does not migrate appreciably from the intended region of the substrate to which it has been applied.

The moisture barrier can for example be applied to the surface of the absorbent substrate in the form of parallel stripes of a hatched or checkered pattern, or indeed any other design pattern, decorative feature or logo.

The detergent active compound or the moisture barrier can additionally comprise a water-soluble dyestuff or colourant, the disappearance of which from the article after repeated use can signal that the article is exhausted of detergent active compound.

The wiping article according to the invention should be substantially dry-to-the-touch, that is substantially free from water in an amount that would make it feel damp or wet to the touch, until it is required for use in cleaning a soiled surface.

The wiping article is conveniently provided in the form of a square or rectangular sheet of a size which is conveniently held in the hand and accordingly has a larger surface area than that of the hand to enable it to be used effectively to clean a soiled surface.

A convenient size of article for use by an adult is one having the area of at least 0.03 $m^2$, more usually at least $0.05m^2$.

EMBODIMENTS OF THE INVENTION

When the wiping article is intended for use in cleaning the surface of the human body, for example when showering, the whole of the absorbent substrate is preferably impregnated with detergent active compound and adjuncts as desired, whereas the moisture barrier will preferably cover from 20 to 70% of the total surface area of the absorbent substrate.

When the wiping article is intended for use in cleaning hard surfaces, the absorbent substrate is preferably impregnated with detergent active compound and adjuncts as desired in a manner such that only a portion (i.e. "a first portion") carries detergent active compound, the remainder of the substrate (i.e. "a second portion") being substantially free from the said detergent active compound.

The water-insoluble moisture barrier which is applied to the surface of the absorbent substrate in order to reduce the rate at which water can penetrate the article and hence leach out detergent active compound and other water-soluble or water-dispersible adjuncts in a controlled manner during use in cleaning a hard surface, preferably covers the "first portion" of the substrate, as herein defined, on both sides thereby to form a sandwich enclosing the detergent active compound carried by that "first portion".

In this embodiment of the invention, the surface area of the "first portion" carrying the detergent active compound can form from 10 to 90% of the total surface area, the surface area of the "second portion" accordingly can also form from 10 to 90% of the total surface area. Preferably, the surface area of each portion should form from 40 to 60%, ideally about 50% of the total surface area of the absorbent substrate.

The first portion can define a single area of the absorbent substrate, or it can define a plurality of areas which are separated one from the other by the second portion.

Preferably, the "first" and "second portions" define parallel striped, hatched or checkered regions in which regions of the "first portion" alternate with regions of the "second portion".

It is accordingly intended that the region or regions of the absorbent substrate which define the "first portion" are adapted to deliver detergent active compound when the article is used to clean a soiled hard surface, and the region or regions of the absorbent substrate which define the "second portion" are adapted to collect soil dislodged from that surface by the action of the detergent active compounds or to polish clean the surface.

The article can be rinsed to remove soil build-up from the "second portion", without significant loss of detergent active compound from the first portion", and then reused.

The durability, bulk and performance of the wiping article in delivering detergent active compound and transferring liquid to and/or from a surface during a cleaning operation can be further improved by providing it with two or more layers of absorbent substrate. For this purpose, separate sheets of absorbent substrate can be laminated so that they adhere closely with each other using an adhesive. Suitable adhesives for use in laminating sheets of absorbent substrate include hydrophobic polymer emulsions, such as can also be employed to form the moisture barrier, as hereinbefore described, or crosslinkable polymers or hotmelt adhesives.

THE DRAWINGS

The invention is further illustrated by the accompanying drawings of which:

Figure 1:
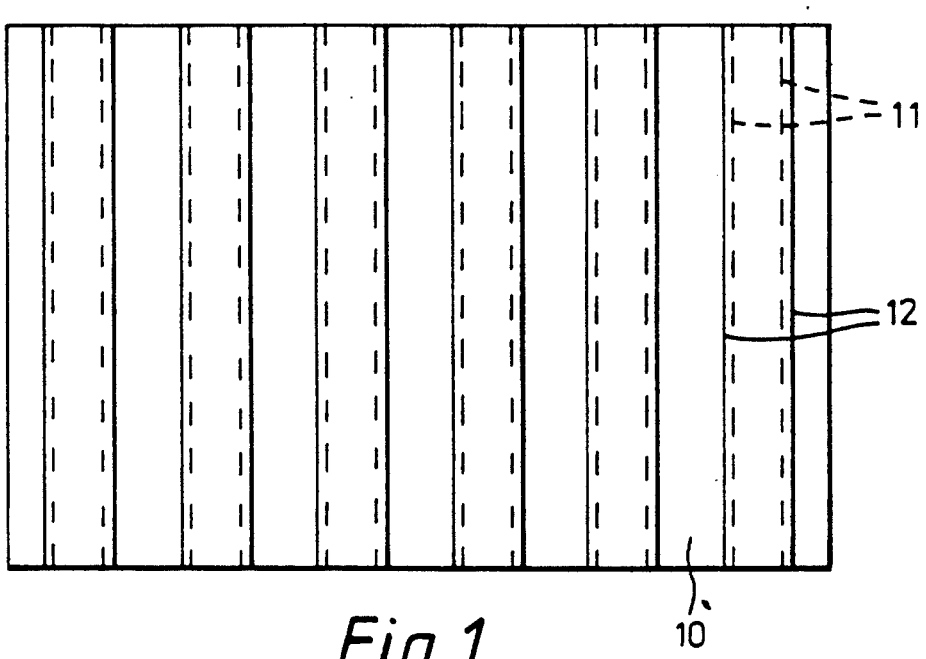
FIG. 1 is a plan view of a wiping article.
Figure 2:
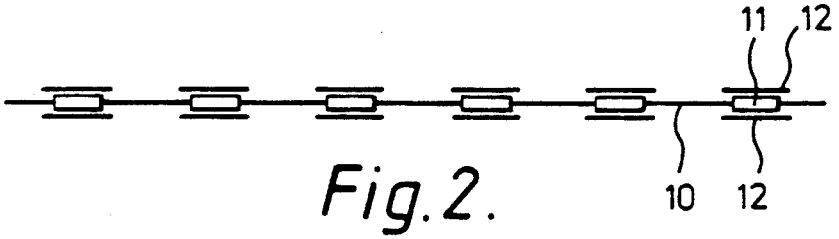
FIG. 2 is a cross-sectional view of the article shown in FIG. 1.

The wiping article as shown in FIGS. 1 & 2 consists of a sheet of absorbent substrate (10), 37 cm×29 cm, having a thickness of 500 μm, impregnated with parallel stripes of detergent active compound (11). Each stripe of detergent active compound is coated on each side of the sheet with a moisture barrier (12) to form a series of sandwiches as shown more particularly in FIG. 2. The width of each moisture barrier stripe is slightly wider than the corresponding detergent active compound stripe.

Figure 3:
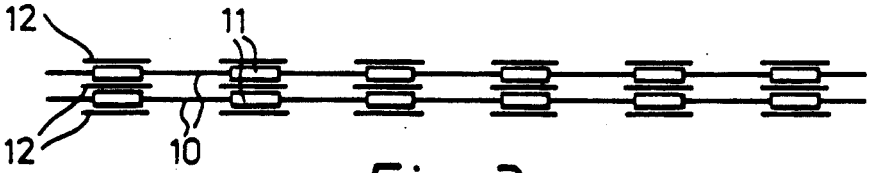
FIG. 3 is a cross-sectional view of a hard surface wiping article having a laminate construction.

The wiping article as shown in FIG. 3 contains the same striped configuration of detergent active compound and moisture barrier as shown in FIGS. 1 and 2, except that two sheets of absorbent substrate are "welded" together by stripes of moisture barrier (12), within the five layered sandwich to form a double laminate wiping article.

Figure 4:
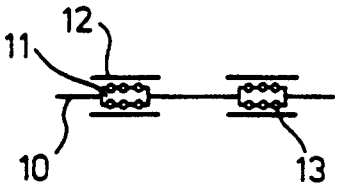
FIGS. 4 & 5 are cross-sectional views of abrasive wiping articles.

The wiping article as shown in FIG. 4 is similar in construction to that shown in FIGS. 1 and 2 with the addition of a particulate abrasive (13) carried by each detergent active compound stripe (11).

Figure 5:
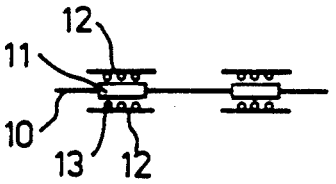

The wiping article as shown in FIG. 5 is similar in construction to that shown in FIG. 4, except the particulate abrasive (13) is carried by the moisture barrier stripe (12) instead of the detergent active compound stripe (11).

Each of the embodiments of the invention as shown in FIGS. 1 to 5 is provided initially in the dry state, i.e. they are dry-to-the-touch. When required for use, they can be moistened with water and used to clean a solid surface or they can be applied in the dry state to a prewetted solid surface and thereafter used to clean the surface and mop up residual moisture.

MANUFACTURE OF WIPING ARTICLE

Wiping articles according to the invention can be prepared simply by application to pieces or a continuous roll of the absorbent substrate of a suitable liquid detergent formulation comprising the detergent active compound and other detergent adjuncts as required.

The liquid detergent formulation can be applied uniformly throughout the absorbent substrate or in a desired pattern, after which the impregnated substrate so obtained is dried in a current of warm air. The moisture barrier can then be applied to both sides of the dried article, by any suitable method of which a printing method, for example using a gravure (recessed) print roller, or a hot melt extrusion technique are preferred.

It may be necessary to employ a further drying step and or a heating step to dry the moisture barrier material and/or to cross-link it, if the chosen moisture barrier material is one which requires cross-linking.

The dry-to-the-touch articles so obtained can be packaged individually until required for use, in for example a pouch of plastics material, or alternatively, they can be packaged in bulk or provided as a continuous roll for use with a suitable dispenser.

Evidence to illustrate controlled release of detergent active compound from wiping article having a partial coating of a hydrophobic moisture barrier material Pieces of STORALENE 717:50 fabric each measuring 220 mm×300 mm which had been dipped in a formulation containing detergent active compound and a green dye stuff were coated on both sides with stripes of MESOWAX, a hydrophobic moisture-barrier material, the stripes coinciding exactly with each other, so that a given area of the fabric was effectively sandwiched between the same area of MESOWAX. The portions of sandwiched impregnated fabric were therefore effectively protected against direct access of water when the articles were subsequently dipped in water. Detergent active compound within each 'sandwich' can, however, be leached out slowly via adjacent uncoated areas by 'wicking' along and between the cellulose fibres of which STORALENE 717:50 is comprised, and also by gradual loss through the barrier.

Pieces of the impregnated, partially coated STORALENE fabric were leached by immersion in each of a series of 10 beakers each containing 250 ml of tap water at 40° C. The duration of immersion in each beaker of water was 30 seconds.

The amount of detergent active compound leached out during each immersion was assessed by measuring spectrophotometrically the amount of dye leached out, the rate of leaching of detergent active compound being proportional to the rate of leaching of the dye.

This experiment was repeated using paraffin wax as a moisture barrier material and also with uncoated STORALENE to provide a control.

The results are shown in Table 1:

It can be concluded from the foregoing results that the presence of a hydrophobic moisture barrier, such as MESOWAX or paraffin wax, considerably reduces the rate at which detergent active compound is leached from the wiping article following contact with water over a period of 5 minutes. Of the coated articles, that having a MESOWAX moisture barrier covering 65% of the total surface area still retained 13% by weight of the detergent active compound with which it had originally been impregnated. Likewise, the corresponding figure for the paraffin wax coated article (53% coverage) was 22%, thus confirming that coverage of at least half of the surface area of the detergent impregnated article with a moisture barrier provided a continuous and controlled supply of detergent active compound following repeated contact with fresh water.

Use of Wiping Article

The wiping articles according to the invention can be employed for cleaning the skin surface and are especially useful when showering, where they can be used to shampoo the hair, as well as clean the whole body surface. The article is preferably capable of producing a copious foam throughout the duration of the shower and will have a wet strength which will be resistant to disintegration when employed under normal conditions of use. The wiping articles can also be used when taking a bath.

Such wiping articles are particularly convenient in that they can be carried in a sportsbag, handbag or pocket in a dry state and that each article contains a measured dose of detergent as well as other skin benefit ingredients that may be present in the formulation. They are intended to be disposable and therefore the problem of hygiene of reusable bath flannels and the like does not occur. The ability of the wiping article gradually to release detergent active compound is an advantage when showering, in that the article is capable of producing a lather for the entire duration of normal shower, i.e. up to 5 minutes. Also, in view of this advantage, each wiping article can carry a lower 'dose' of detergent active compound than corresponding uncoated articles.

The wiping articles according to the invention can alternatively be used for cleaning hard surfaces, for which purpose they are conveniently packaged in a plastic pouch or cardboard carton from which they can be removed prior to use.

TABLE 1

| | | Accumulating total of detergent active leached from wiping article (%) | | | | |
|---|---|---|---|---|---|---|
| Beaker No. | Total leaching (mins.) | Control (uncoated) | MESOWAX (38% coverage) | MESOWAX (53% coverage) | MESOWAX (65% coverage) | Parrafin wax (53% coverage) |
| 1 | 0.5 | 36 | 18 | 10 | 10 | 18 |
| 2 | 1 | 74 | 43 | 28 | 26 | 40 |
| 3 | 1.5 | 90 | 59 | 44 | 43 | 53 |
| 4 | 2 | 95 | 70 | 56 | 55 | 59 |
| 5 | 2.5 | 98 | 79 | 66 | 67 | 65 |
| 6 | 3 | 99 | 86 | 74 | 75 | 69 |
| 7 | 3.5 | 100 | 91 | 80 | 80 | 72 |
| 8 | 4 | — | 95 | 85 | 83 | 74 |
| 9 | 4.5 | — | 97 | 89 | 85 | 76 |
| 10 | 5 | — | 99 | 92 | 87 | 78 |

dry weight of STORALENE (g) 3.3 wet tensile strength across web (N/m) 274
dry weight of detergent formulation (g) 1.17 wet tensile strength machine direction (N/m) 354
dry weight of wiping article (g) 4.47

Such wiping articles are particularly suited for repeated use in the cleaning of soiled hard surfaces, such as kitchen worktops, baths and basins or floors. They can accordingly find particular utility in schools, restaurants, dining rooms and hospitals as well as in the home.

SPECIFIC EXAMPLES

The invention is illustrated by the following examples:

EXAMPLE 1

This example illustrates a kitchen hard surface non-scouring wipe according to the invention.

Pieces of MITSUBISHI TCF 408 as the absorbent substrate were impregnated with an aqueous detergent active-containing solution having the following formulation:

| | % w/w |
|---|---|
| TEXOFOR B1 (a higher fatty alcohol containing 16 EO) | 20 |
| ARQUAD 16/50 (palmitoyl quaternary ammonium chloride - 50% AD) | 10 |
| Yellow 2G dye | 0.1 |
| Perfume | 0.2 |
| Water | 69.7 |

The water insoluble moisture barrier employed as a slow release agent was VINAMUL 3231.

The individual wipes were prepared according to the following procedure:

The detergent solution was "printed" onto the substrate using a foam rubber pad to give stripes of detergent each approximately 8 mm wide (the "first portion"). The detergent solution was allowed to dry at ambrent temperature, and then the moisture barrier was applied using a paint brush, to both sides of the substrate so as to cover the detergent stripes, without undue disruption of the underlying detergent, and to extend a little on either side of each stripe over the untreated areas between the stripes (the "second portion"). The moisture barrier was allowed to dry at ambient temperature and was then cross-linked by heating at 140° C. for 5 minutes in an oven.

The wipe so prepared had the following specification:

| | |
|---|---|
| Overall size (mm) | 300 × 370 |
| Overall area ($m^2$) | 0.111 |

Area of "first portion" covered by

| | |
|---|---|
| detergent ($m^2$) | 0.0456 |
| % area "first portion" | 40% |
| % area coated with slow release agent | 45% |
| Dry weight of substrate (g) | 9 |
| Dry weight of first portion (g) | 3.6 |
| Dry weight of substrate + detergent (g) | 14 |
| Dry weight of detergent (g) | 5 |
| Dry weight of wipe (g) | 21 |
| Dry weight of moisture barrier (g) | 7 |

Loading ratio of detergent to substrate (5:3.6)=1.39.

The moisture barrier is used to permit gradual release of the detergent. The detergent stripes contain a dye, (yellow 2G), which acts as a detergent release indicator. Thus when the wipes no longer appear yellow the detergent is exhausted.

EXAMPLE 2

This example illustrates a disposable shower flannel according to the invention.

Pieces of STORALENE (715:50) fabric containing 40% by weight of cellulose fibres were immersed in a detergent formulation which contained the following ingredients:

| | % w/w |
|---|---|
| Sodium lauryl ether sulphate - 2EO (28% AD) | 30.5 |
| Coconut diethanolamide | 2.5 |
| Formalin (36.6%) | 0.1 |
| Other minor ingredients including colourant, perfume, inorganic salt | 3.79 |
| Water | to 100 |

The pH was adjusted to 5.6 with citric acid.

The pieces of STORALENE fabric after immersion in the above detergent formulation were allowed to drain and were then air dried.

Parallel stripes of MESOWAX (a wax emulsion) were then applied to corresponding areas on both surfaces of the detergent-impregnated fabric with a paint brush, so that 40% of the total surface area was covered, 40% of the fabric thereby being sandwiched between the striped area. The MESOWAX was air dried leaving visible orange stripes of waxy material on the fabric.

The wiping articles so prepared were checked for size, weight and other data, the results of which are given below:

| | |
|---|---|
| Size of wiping article (mm) | 225 × 287 |
| Area of wiping article ($m^2$) | 0.0646 |
| Area of MESOWAX ($m^2$) | 0.0258 |
| Percentage of total area covered by MESOWAX (%) | 40 |
| Dry weight of wiping article (g) | 8.52 |
| Dry weight of absorbent substrate: STORALENE (g) | 3.14 |
| Dry weight of detergent formulation (g) | 5.38 |
| Loading of anionic detergent (g/g matrix) | 0.67 |
| Loading of total water soluble solids (g/g matrix) | 1.71 |
| Wet tensile strength: across the web (N/m) | 274 |
| Wet tensile strength: in machine direction (N/m) | 354 |

EXAMPLE 3

The procedure described in Example 2 was repeated, except that the detergent formulation with which the absorbent substrate was impregnated had the following formulation:

| Ingredient | % w/w |
|---|---|
| MIRANOL 2 MCA Mod* | 45 |
| EMPICOL ESB 3** | 30 |
| Citric acid | 0.1 |
| Perfume, colour | qs |
| Water to | 100 |

*cocoamphocarboxyglycinate + sodium lauryl sulphate + hexylene glycol (48% AD)

**sodium lauryl ether sulphate (3EO)

EXAMPLE 4

This Example illustrates a disposable shower flannel according to the invention.

Pieces of STORALENE (715:50) fabric containing 40% by weight of cellulose fibres were immersed in a detergent formulation which contained the following ingredients:

| | % w/w |
|---|---|
| MIRANOL 2 MCA Mod | 45 |
| EMPICOL ESB 3 | 30 |
| Citric acid | 0.1 |
| Perfume, colour | qs |
| Water to | 100 |

The pieces of STORALENE fabric after immersion in the above detergent formulation were allowed to drain and were then air dried.

Parallel stripes of VINAMUL 3240 as the water insoluble moisture barrier material were then applied to corresponding areas on both sides of the detergent-impregnated fabric so that 45% of the total surface area was covered, 45% of the fabric thereby being sandwiched between the striped area.

The size and other data relevant to the wiping articles so prepared were similar to that relating to the article disclosed in Example 2.

Wiping articles prepared as described above in Examples 2 to 4 were submitted for evaluation by a panel of three testers for use in the shower. Similar articles but without polymer coating were also tested by the panel.

In each case the wiping articles were weighed before and after a single use under the shower to determine the amount of residual detergent active held by each article. The results are shown in Table 2:

TABLE 2

| | Detergent remaining in article after use (%) | | Difference: coated minus |
|---|---|---|---|
| Panellist | uncoated | coated | uncoated (%) |
| 1 | 9.9 | 51.1 | 41.2 |
| 2 | 33.3 | 54.5 | 21.2 |
| 3 | 0.7 | 35.3 | 34.6 |

These results indicate that a substantial proportion of detergent is lost from the wiping articles after use where no protective water-insoluble moisture barrier is applied. Conversely, where such a barrier is present, loss of detergent during use is considerably reduced thus enabling the article to be used for a longer than usual period under the shower or for repeated use on successive occasions.

We claim:

1. A substantially dry-to-the-touch wiping article which is suitable for use in cleaning soiled surfaces in the presence of water, the article comprising an absorbent substrate, having a water-absorption capacity of at least 1 g/g, in the form of a sheet impregnated with detergent active compound, the surface of the absorbent substrate having applied thereon a moisture barrier to cover from 10% to 95% of the total area of each side of the sheet in such a manner that the moisture barrier on one side coincides with the moisture barrier on the opposite side, so as to form a sandwich enclosing from 10% to 95% of the area of the absorbent substrate impregnated with detergent active compound, said moisture barrier and said detergent active compound being in separate layers, and wherein the absorbent substrate comprises a first portion impregnated with said detergent active compound and a second portion substantially free from detergent active compound, the first portion defining a plurality of areas of the absorbent substrate which are separated from each other by the second portion.

2. The article of claim 1, wherein the absorbent substrate is a nonwoven fabric sheet having a thickness of from 100 to 1000 μm comprising cellulose fibres.

3. The article of claim 1, wherein the absorbent substrate comprises fibrous materials chosen from polyamide, polyester, polypropylene or mixtures thereof.

4. The article of claim 1, which has a minimum wet tensile strength of at least 50 N/m.

5. The article of claim 1, which has a wet tensile strength of from 95 to 1000 N/m.

6. The article of claim 1, wherein the detergent active compound is chosen from anionic, nonionic, amphoteric, zwitterionic or cationic detergent active compounds or compatible mixtures thereof.

7. The article of claim 1, wherein the detergent-active compound comprises a soap.

8. The article of claim 1, wherein at least part of the absorbant substrate is impregnated with the detergent active compound at a concentration of at least 0.2 g/g.

9. The article of claim 1, wherein at least part of the absorbant substrate is impregnated with the detergent active at a concentration of from 0.4 to 2 g/g.

10. The article of claim 1, further comprising securely bound particles of an abrasive material.

11. The article of claim 1, wherein the moisture barrier comprises a hydrophobic material chosen from hot melts, waxes, wax emulsions, polymer emulsions, silicones, silicone oil and silicone wax mixtures, natural and synthetic rubbers, resins and mixtures thereof.

12. The article of claim 1, wherein the moisture barrier comprises a hydrophilic material chosen from polyvinyl alcohol, gelatin, starch and mixtures thereof.

13. The article of claim 1, wherein the first portion is coated on both sides of the absorbent substrate sheet to form a sandwich enclosing the detergent active compound.

14. The article of claim 1, wherein the moisture barrier covers from 20 to 70% of the total area of each side of the absorbent substrate sheet.

* * * * *